United States Patent [19]

Doyle

[11] Patent Number: 4,520,256

[45] Date of Patent: May 28, 1985

[54] HOT AIR CURLER HAVING A REMOTE AIR INLET AND A SLIDE SWITCH AND ACTUATING ARM WITHIN ITS HANDLE

[75] Inventor: Edward J. Doyle, Hatboro, Pa.

[73] Assignee: Conair Corporation, Edison, N.J.

[21] Appl. No.: 494,997

[22] Filed: May 16, 1983

[51] Int. Cl.[3] ..... H05B 1/02; A45D 2/36; A45D 1/04; H01H 15/00

[52] U.S. Cl. ..... 219/225; 132/9; 132/11 R; 132/37 R; 200/157; 219/240; 219/364; 219/370; 219/373; 219/533

[58] Field of Search ..... 219/222, 225, 226, 240, 219/533, 373, 370, 369, 364; 34/96-101, 243 R; 132/7, 9, 11 R, 11 A, 33 R, 37 R; 200/157

[56] References Cited

U.S. PATENT DOCUMENTS

| | | | |
|---|---|---|---|
| 3,491,774 | 1/1970 | Carbone | 132/33 R |
| 3,518,776 | 7/1970 | Wolff et al. | 34/97 |
| 3,613,257 | 10/1971 | Yashiike et al. | 34/97 X |
| 3,698,402 | 10/1972 | Arnesen | 219/225 X |
| 4,085,309 | 4/1978 | Godel et al. | 34/97 X |
| 4,195,217 | 3/1980 | Moller et al. | 219/370 |
| 4,280,026 | 7/1981 | Alessio | 200/157 |
| 4,309,595 | 1/1982 | Long et al. | 219/373 X |
| 4,380,693 | 4/1983 | Kuhlmann et al. | 200/157 X |
| 4,421,964 | 12/1983 | Buchtel | 200/157 |

FOREIGN PATENT DOCUMENTS

| | | | |
|---|---|---|---|
| 2556808 | 7/1976 | Fed. Rep. of Germany | 132/9 |
| 2502821 | 7/1976 | Fed. Rep. of Germany | 219/373 |
| 588835 | 6/1977 | Switzerland | 219/370 |

*Primary Examiner*—A. Bartis
*Attorney, Agent, or Firm*—Haynes N. Johnson

[57] ABSTRACT

A hot air hair curler includes a cylindrical hollow handle having an air inlet at one end and a cylindrical hollow barrel having air outlet openings in its sidewall extending from the other end. An electric heating element and a motor driven fan are enclosed within the handle, together with a switch to which is connected an electrical supply cord. The switch, being relatively large, is positioned in the handle near the air inlet and is connected to a slide button positioned forwardly on the handle by a rigid actuating arm positioned within a longitudinal channel within the handle. The actuating arm defines a wireway providing convenient routing for wires from the switch to the motor and heating element.

3 Claims, 8 Drawing Figures

HOT AIR CURLER HAVING A REMOTE AIR INLET AND A SLIDE SWITCH AND ACTUATING ARM WITHIN ITS HANDLE

BACKGROUND OF THE INVENTION

This invention pertains to hot air hair curlers and, more particularly, to such curlers of the type which are likely to be used in the home or while traveling. It is important that curlers of this type be as small and compact as reasonably possible. However, this has not been easy to accomplish. Hot air curlers include an electrically operated fan and an electrical heating element. The fan pulls air into the body of the curler, forces it past a heating element and into a barrel around which the hair is wrapped. The heated air is expelled through the barrel via air outlet openings in its surface, causing the hair to assume a set or curl.

One of the difficulties encountered in attempting to reduce the size of such a curler is that relatively high currents are required, especially to supply the heating element. As a result of the relatively high currents, a relatively large switch is also required. Advantageously, control of the switch should be from a finger tip control position near the forward end of the handle, i.e., the end from which the barrel protrudes. However, a large switch in such a location would interfere with the heater, the fan motor, and the air flow. Prior art attempts to overcome this problem resulted in the use of smaller switches. However, undersized switches are unsafe and some have been refused Underwriter's Laboratories approval. Another problem which must be overcome when reducing the size of a curler is that of making the air inlet opening sufficiently large to insure the required volume of air. Since the air inlet opening is normally at the same end of the housing as the incoming power cord, the latter may interfere with the obtaining of a reasonably large volume of air.

Accordingly, it is a primary object of the present invention to provide a hot air hair curler which is small and compact, but includes a switch of adequate size to safely handle the electrical load. Another object is to provide such a curler wherein the air inlet opening is sufficiently large to insure an adequate supply of heated air. Other objects, features, and advantages will become apparent from the following description and appended claims.

SUMMARY OF THE INVENTION

The invention resides in an improvement in a hot air curling iron of the type which includes a cylindrical, hollow handle having air inlet openings at one end and a cylindrical, hollow barrel extending outwardly from the other end. The barrel defines an air passage with the interior of the handle, has a closed distal end, and has air outlet openings in its sidewall. Contained within the hollow handle near its front end is an electric air heater and substantially centrally positioned in the hollow handle is an electric motor and fan. An electrical power supply cord enters the end of the housing and is electrically connected through a switch within the handle to the motor and air heater. The improvement comprises the positioning of the electric switch at the rear end of the handle. A switch actuating slide is externally mounted on the hollow handle near its front end and an actuating arm within the hollow handle reciprocates parallel to the longitudinal axis of the handle. One end of the arm engages the slide for movement therewith and the other end is in actuating relationship with the switch.

DESCRIPTION OF THE PREFERRED EMBODIMENT

Figure 1:
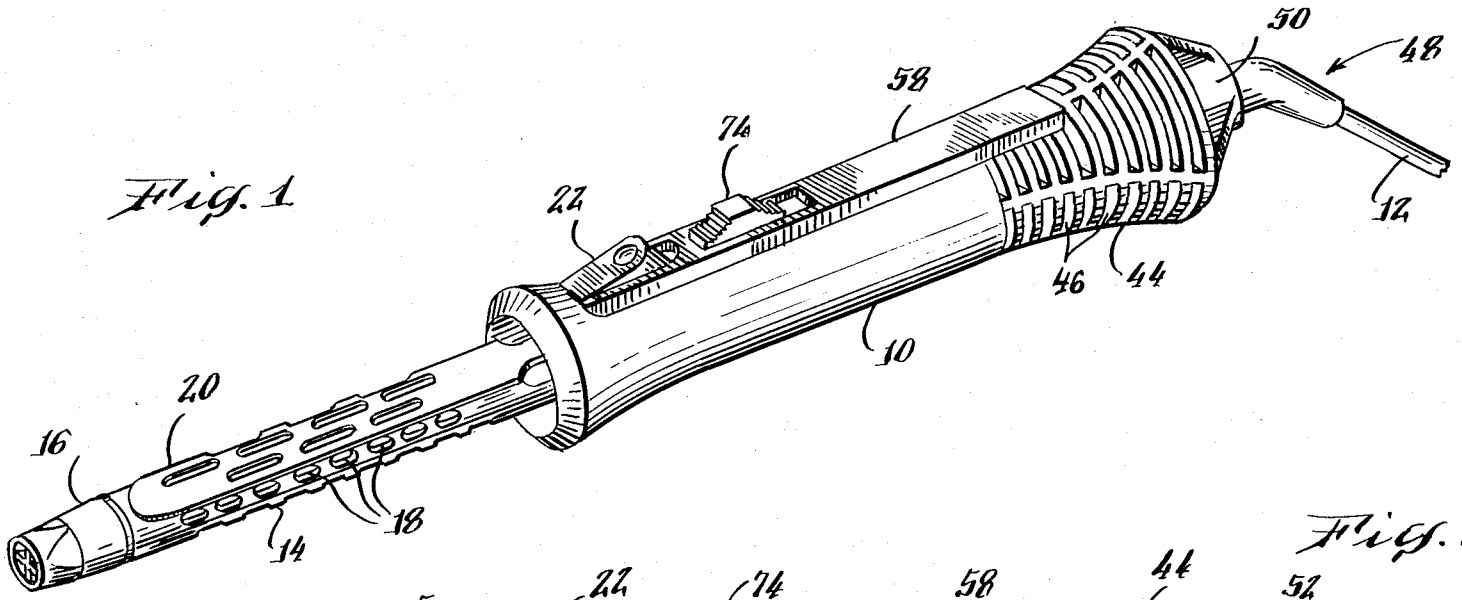
FIG. 1 is a perspective view of a hot air hair curler in accordance with the invention.
Figure 2:
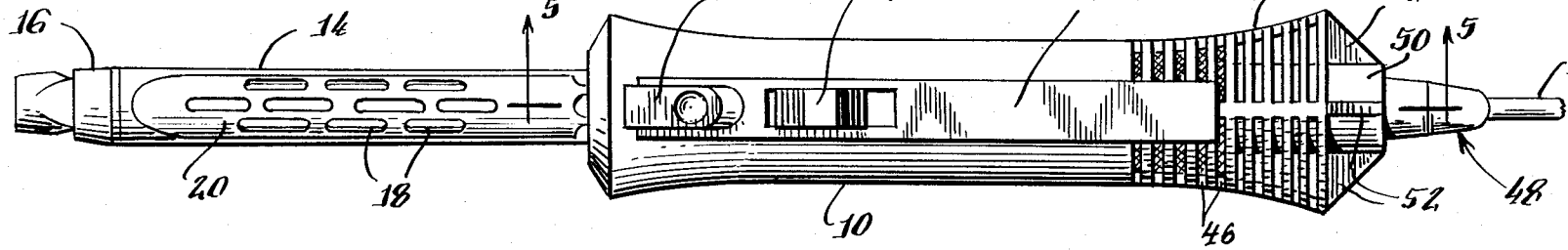
FIG. 2 is a top view of the curler of FIG. 1.
Figure 4:
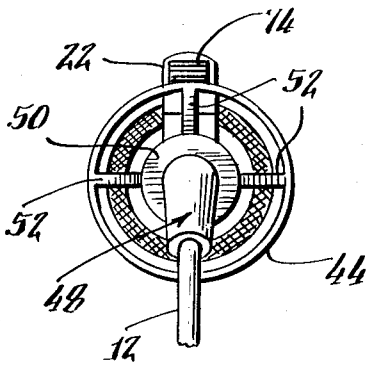
FIG. 4 is a rear view of the curler of FIG. 2.
Figure 3:
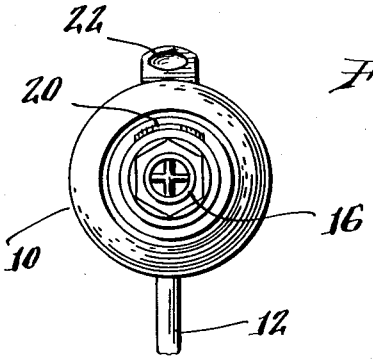
FIG. 3 is a front view of the curler of FIG. 2.
Figure 5:
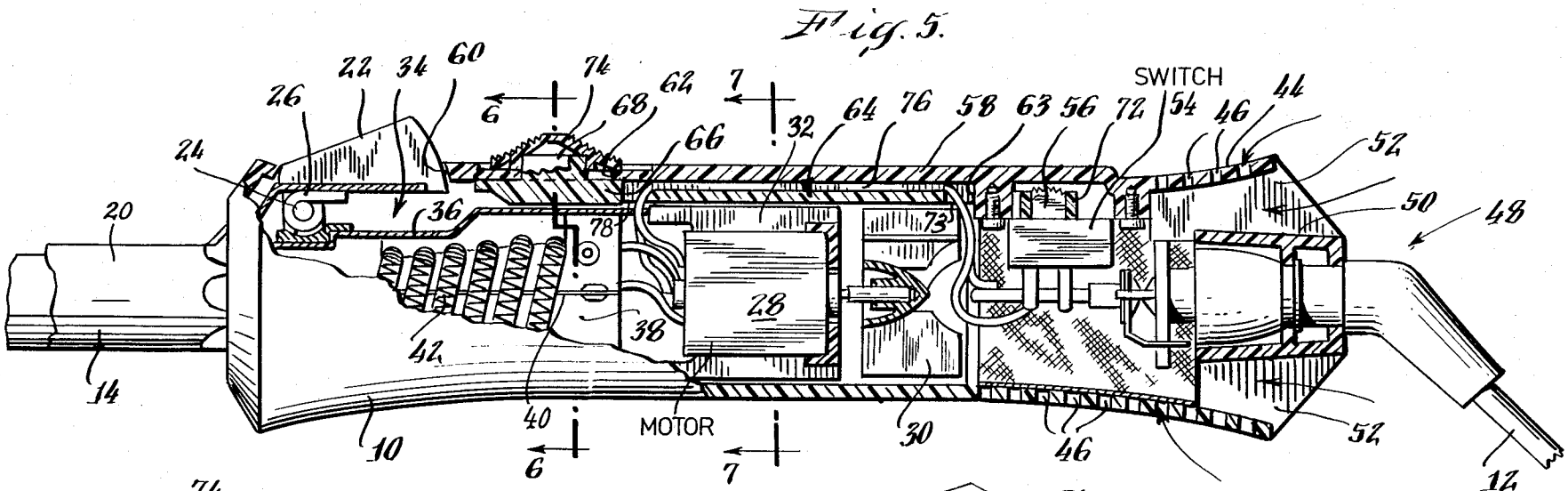
FIG. 5 is an enlarged view, partially broken away, along the line 5—5 of FIG. 2.

With particular reference to FIG. 1, there is illustrated a hot air curler in accordance with the present invention. It comprises a hollow plastic handle 10 which is substantially cylindrical, although flared at each end. An electrical power supply cord 12 is connected into the rear end of the handle 10 and a hollow cylindrical barrel 14 projects outwardly from the front end of the handle 10. The barrel 14 is relatively conventional for devices of this type and is closed at its distal end by a cap 16. Its sidewall defines a plurality of air outlet openings 18. Also conventional is a hair clamping blade 20 which overlies the barrel and is operable by a button 22 by which it may be lifted about a pivot 24 against the reaction of a spring 26 (FIG. 5).

Figure 7:
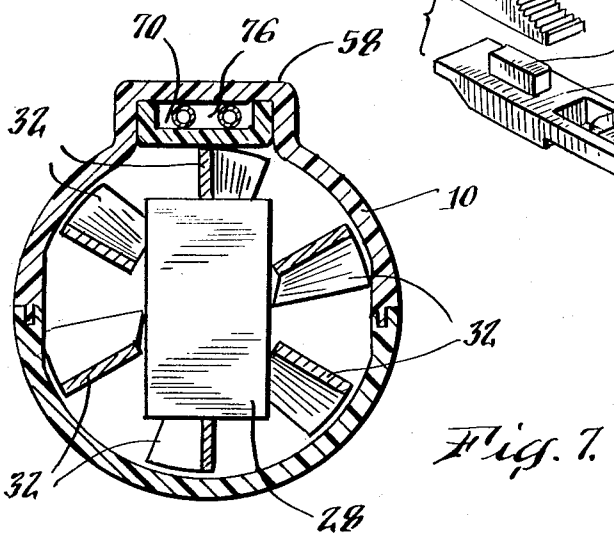
FIG. 7 is an enlarged cross-section taken substantially along the line 7—7 of FIG. 5.

Housed within the central portion of the handle 10 is an electric motor 28 having a horizontal shaft upon which is mounted an air impeller 30. Motor 28 and impeller 30 are designed to force air from the rear of handle 10 into the barrel 14, or form right to left as viewed in FIG. 5. Motor 28 is centrally positioned within the housing 10 by a plurality of helical air diffuser vanes 32 as shown in FIG. 7.

Figure 6:
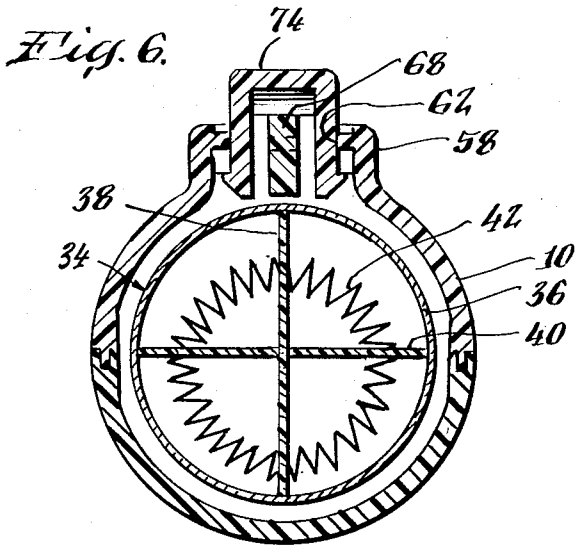
FIG. 6 is an enlarged cross-section taken substantially along the line 6—6 of FIG. 5.

Mounted within the forward end of the handle 10 is a heater assembly 34. Heater assembly 34 comprises an external can 36 which is open at its two ends and contains a vertically oriented heater board 38 and an auxiliary board 40 at right angles thereto (FIG. 6). Both the heater board 38 and the auxiliary board 40 are notched and carry a resistance heating coil 42 spirally wrapped around them.

At its rear end, the handle 10 has a substantial outward flare 44 and contains a plurality of circumferential air inlet slots 46. A line cord swivel 48 is supported within the flared end of the handle 10 by a cylindrical hub 50 and four radial supporting fins 52. The spaces between the fins define air inlet openings.

Mounted within the rear end of the handle 10, and just ahead of the termination of cord 12 at swivel 48, is an on/off switch 54 having a button 56 longitudinally movable between an "off" and an "on" position. The switch 54 is of relatively large size so as adequately to handle the combined currents drawn by motor 28 and heating coil 42. Its rear mounted position within the handle 10 keeps it away from the heater assembly 34 and the motor 28 so as to avoid any undue blocking of the air flow between the inlets in and around the flare 44 and the barrel 14.

Figure 8:
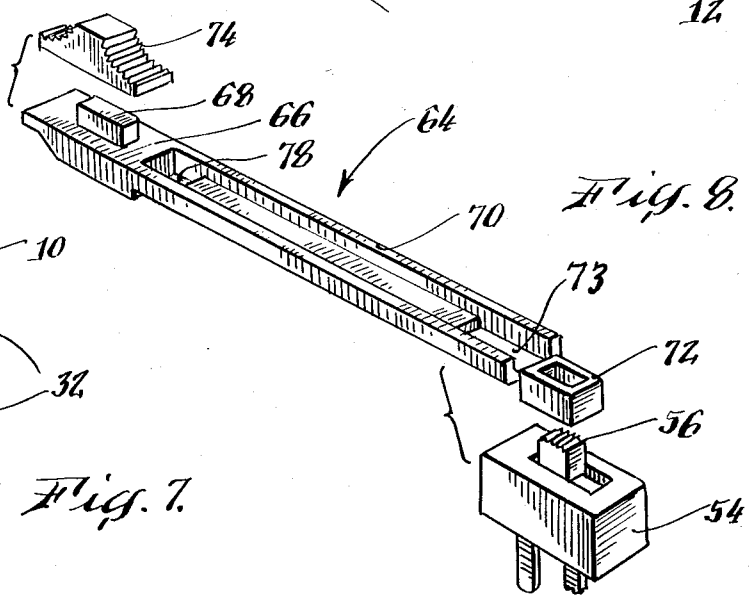
FIG. 8 is an exploded view of the switch actuating mechanism of the invention.

In order to control the switch 54 from a more convenient position, the housing 10 is formed with a longitudinally extending channel 58 of substantially rectangular cross-section along its upper surface. The channel 58 defines a slot 60 at its forwardmost end which contains the spade button 22. Just behind the slot 60 is a second longitudinal slot 62 (FIGS. 5 and 6). The opposite end of channel 58 caries a downwardly projecting lug 63. Slidably mounted within the channel 58 and exrtending between slot 62 and switch button 56 is a switch bar 64 shown most clearly in FIG. 8. The switch bar 64 comprises a forwardmost block 66 having a vertically extending actuator 68 which extends throught the slot 62. A U-shaped channel arm 70 extends rearwardly from the block 66 through the channel 58 and terminates in a rectangular socket 72 which receives the switch button 56. A guideway 73 forward of socket 72 slidably engages lug 63. It will thus be seen that longitudinal movement of the switch bar 64 within the channel 58 will serve to actuate the switch button 56 and control switch 54. This is accomplished by means of a switch slide 74 contained within the slot 62 and engaging the actuator 68. The positioning of the slide 74 at the top exterior and toward the front end of handle 10 renders it easily controllable by the finger of the user.

In addition to its switch control function, the channel arm 70 of switch bar 64 also defines a wireway 76 which terminates at its forward end in an opening 78 through the bottom of the channel arm 70. The wireway 76 provides a convenient routing for wires from the switch 54 through the wireway and downwardly through the opening 78 for connection to the motor 28 and the heater assembly 34.

It will now be apparent that the construction of this invention results in a hot air curler which may have a substantial heating capacity and adequate provision for a reliable switch without sacrificing air flow volume. Another feature of this invention is the fact that the flare 44 of handle 10 is sufficiently large to discourage the average user from grasping the handle in such a fashion as to block incoming air. It will also be apparent that a number of variations and modifications may be made in this invention without departing from its spirit and scope. Accordingly, the foregoing description is to be construed as illustrative only, rather than limiting. This invention is limited only by the scope of the following claims.

What is claimed is:

1. In a hot air hair curling iron including a substantially cylindrical hollow handle having first and second ends and defining air inlet openings adjacent said second end, a substantially cylindrical hollow barrel extending outwardly from the first end of said handle having a proximal end defining an air passage with the interior of said handle, a closed distal end, and a sidewall defining air outlet openings therein, an electric air heater within said hollow handle at its first end, an electric motor and fan within said hollow handle at substantially its central portion, an electric slide switch within said hollow handle, said switch positioned so said slide moves longitudinally to said handle, and an electrical power supply cord terminating in the second end of said housing and electrically connected through said switch to said motor and air heater, the improvement which comprises:

said electric switch being positioned within the second end of said handle;

a switch actuating slide externally mounted on said hollow handle adjacent its first end; and a rigid actuating arm positioned within said hollow handle for reciprocation parallel to its longitudinal axis, said handle including a longitudinal channel housing said actuating arm therein, and said arm having a first end engaging said slide for movement therewith and a second end in actuating relationship with said switch.

2. The improvement of claim 1 wherein said channel includes a projecting lug therein and said actuating arm defines a guideway slidably enclosing said lug.

3. In a hot air hair curling iron including a substantially cylindrical hollow handle having first and second ends and defining air inlet openings adjacent said second end, a substantially cylindrical hollow barrel extending outwardly from the first end of said handle having a proximal end defining an air passage with the interior of said handle, a closed distal end, and a sidewall defining air outlet openings therein, an electric air heater within said hollow handle at its first end, an electric motor and fan within said hollow handle at substantially its central portion, an electric switch within said hollow handle, and an electrical power supply cord terminating in the second end of said housing and electrically connected through said switch to said motor and air heater, the improvement which comprises:

said electric switch being positioned at essentially the second end of said handle;

a switch actuating slide externally mounted on said hollow handle adjacent its front end;

an actuating arm positioned within said hollow handle for reciprocation parallel to its longitudinal axis, said arm having a first end engaging said slide for movement therewith and a second end in actuating relationship with said switch;

a wireway defined by said actuating arm in cooperation with the inside of said handle adjacent to said actuating arm; and electrical wires extending through said wireway and connecting said switch to the motor and the air heater.

* * * * *